US011542580B2

(12) United States Patent
Fukaya et al.

(10) Patent No.: US 11,542,580 B2
(45) Date of Patent: Jan. 3, 2023

(54) METHOD FOR MANUFACTURING AL—SI—MG ALUMINUM ALLOY CAST MATERIAL

(71) Applicants: NIKKEI MC ALUMINIUM CO., LTD., Tokyo (JP); MAZDA MOTOR CORPORATION, Hiroshima (JP)

(72) Inventors: Katsumi Fukaya, Tokyo (JP); Hiroshi Horikawa, Tokyo (JP); Yutaro Kitaki, Tokyo (JP); Makato Otsuka, Hiroshima (JP); Tsutomu Masuda, Kure (JP); Naoaki Yamamoto, Higashihiroshima (JP)

(73) Assignees: NIKKEI MC ALUMINIUM CO., LTD., Tokyo (JP); MAZDA MOTOR CORPORATION, Hiroshima (JP)

( * ) Notice: Subject to any disclaimer, the term of this patent is extended or adjusted under 35 U.S.C. 154(b) by 301 days.

(21) Appl. No.: 16/643,498

(22) PCT Filed: Mar. 27, 2018

(86) PCT No.: PCT/JP2018/012595
§ 371 (c)(1),
(2) Date: Feb. 28, 2020

(87) PCT Pub. No.: WO2019/186739
PCT Pub. Date: Oct. 3, 2019

(65) Prior Publication Data
US 2020/0190647 A1 Jun. 18, 2020

(51) Int. Cl.
*C22F 1/043* (2006.01)
*B22D 21/04* (2006.01)
*C22C 21/02* (2006.01)

(52) U.S. Cl.
CPC ..... *C22F 1/043* (2013.01); *B22D 21/04* (2013.01); *C22C 21/02* (2013.01)

(58) Field of Classification Search
None
See application file for complete search history.

(56) References Cited

FOREIGN PATENT DOCUMENTS

| | | |
|---|---|---|
| CN | 106244957 A | 12/2016 |
| JP | S52-156117 A | 12/1977 |

(Continued)

OTHER PUBLICATIONS

Extended European Search Report issued in corresponding European Patent Application No. 18913036.2, dated Sep. 21, 2021.

(Continued)

*Primary Examiner* — George Wyszomierski
*Assistant Examiner* — Janell C Morillo
(74) *Attorney, Agent, or Firm* — McDermott Will & Emery LLP

(57) ABSTRACT

A method for manufacturing an Al—Si—Mg aluminum alloy casting material is provided. The method for manufacturing an Al—Si—Mg aluminum alloy casting material includes performing heat treatment on an Al—Si—Mg aluminum alloy casting material containing 5 mass % or larger and 10 mass % or smaller of Si, 0.2 mass % or larger and 1.0 mass % or smaller of Mg, 0.03 mass % or larger and 0.5 mass % or smaller of Sb, and 0.0004 mass % or larger and 0.0026 mass % or smaller of Be, and a remainder having an alloy composition including Al and unavoidable impurities.

3 Claims, 2 Drawing Sheets

(56) References Cited

FOREIGN PATENT DOCUMENTS

| | | | | |
|---|---|---|---|---|
| JP | S57-169056 | A | | 10/1982 |
| JP | 59064736 | A | * | 4/1984 |
| JP | S59-064736 | A | | 4/1984 |
| JP | S63-162832 | A | | 7/1988 |
| JP | H02-043339 | A | | 2/1990 |
| JP | H2-285042 | A | | 11/1990 |
| JP | H04-2740 | A | | 1/1992 |
| JP | 2012-050993 | A | | 3/2012 |

OTHER PUBLICATIONS

International Search Report issued in corresponding International Patent Application No. PCT/JP2018/012595, dated May 22, 2018, with English translation.

Chinese Office Action issued in corresponding Chinese Patent Application No. 201880057259, dated Jan. 20, 2021, with English translation.

* cited by examiner

| | CAST SURFACE | CAST APPEARANCE AFTER HEAT TREATMENT |
|---|---|---|
| COMPARATIVE EXAMPLE 2 | SILVERY-WHITE |  |
| EXAMPLE 6 | SILVERY-WHITE |  |
| COMPARATIVE EXAMPLE 3 | BLACK |  |

METHOD FOR MANUFACTURING AL—SI—MG ALUMINUM ALLOY CAST MATERIAL

CROSS-REFERENCE OF RELATED APPLICATIONS

This application is a National Stage under 35 U.S.C. § 371 of International Patent Application No. PCT/JP2018/012595 filed on Mar. 27, 2018, which designates the United States, the entire contents of which are incorporated herein by reference.

1. TECHNICAL FIELD

The present invention relates to a method for manufacturing an Al—Si—Mg aluminum alloy casting material. The present invention is particularly suitable for a large casting material such as those used for an automobile component.

2. DESCRIPTION OF THE RELATED ART

Casting alloys are known (such as alloy A356 specified by the American Society for Testing and Materials (ASTM)), which are aluminum (Al) alloys containing silicon (Si) and having added magnesium (Mg) for improving mechanical properties of an Al—Si aluminum alloy with favorable castability. The Mg added for improved strength may be oxidized and depleted in a molten state, thereby promoting oxide production and gas absorption. The addition of beryllium (Be) to the Al—Si—Mg aluminum alloy is known to inhibit Mg depletion.

The addition of antimony (Sb) to the Al-Si-Mg aluminum alloy AC4C or AC4A specified in Japanese Industrial Standards (JIS) H 5202, for example, is known to improve (refine) a Si phase in a eutectic structure and thus improve an elongation property (refer to Prior Art 1).

However, when the Al-Si-Mg aluminum alloy with added Sb undergoes high-temperature heat treatment such as solution treatment, a cast surface may turn black, thereby damaging its appearance. Proposals for inhibiting the blackening of the cast surface include the addition of a large amount of Be to the Al-Si-Mg aluminum alloy to which Sb has been added, and the combined addition of Be and Ca (refer to Prior Art 2 and Prior Art 3).

Prior Art 1: Japanese Laid-open Patent Publication No. 52-156117

Prior Art 2: Japanese Laid-open Patent Publication No. 63-162832

Prior Art 3: Japanese Laid-open Patent Publication No. 59-064736

As per Prior Art 2, the blackening is inhibited when a Be content is 0.05 mass % or larger. Adequate care is required in handling Be because Be is a rare metal and therefore expensive, and because Be dust is highly toxic.

The present invention has been made in consideration of the above matters and is directed to providing a method for manufacturing an Al—Si—Mg aluminum alloy casting material with a low Be content and an excellent appearance after heat treatment.

SUMMARY

According to an aspect, a method for manufacturing an Al—Si—Mg aluminum alloy casting material includes:

performing solution treatment on an Al—Si—Mg aluminum alloy casting material containing 5 mass % or larger and 10 mass % or smaller of Si, 0.2 mass % or larger and 1.0 mass % or smaller of Mg, 0.03 mass % or larger and 0.5 mass % or smaller of Sb, and 0.0004 mass % or larger and 0.0026 mass % or smaller of Be, and a remainder having an alloy composition including Al and unavoidable impurities; performing quenching treatment; and performing aging treatment.

As a preferred aspect, the heat treatment includes:

solution treatment in which a temperature is held at 500° C. or higher and 550° C. or lower for 2 hours or longer and 12 hours or shorter; quenching treatment after the solution treatment; and aging treatment in which a temperature is held at 120° C. or higher and 180° C. or lower for 2 hours or longer and 12 hours or shorter after the quenching treatment.

According to the aspect of the present invention, the method for manufacturing an Al—Si—Mg aluminum alloy casting material can be provided.

DETAILED DESCRIPTION

Figure 1:
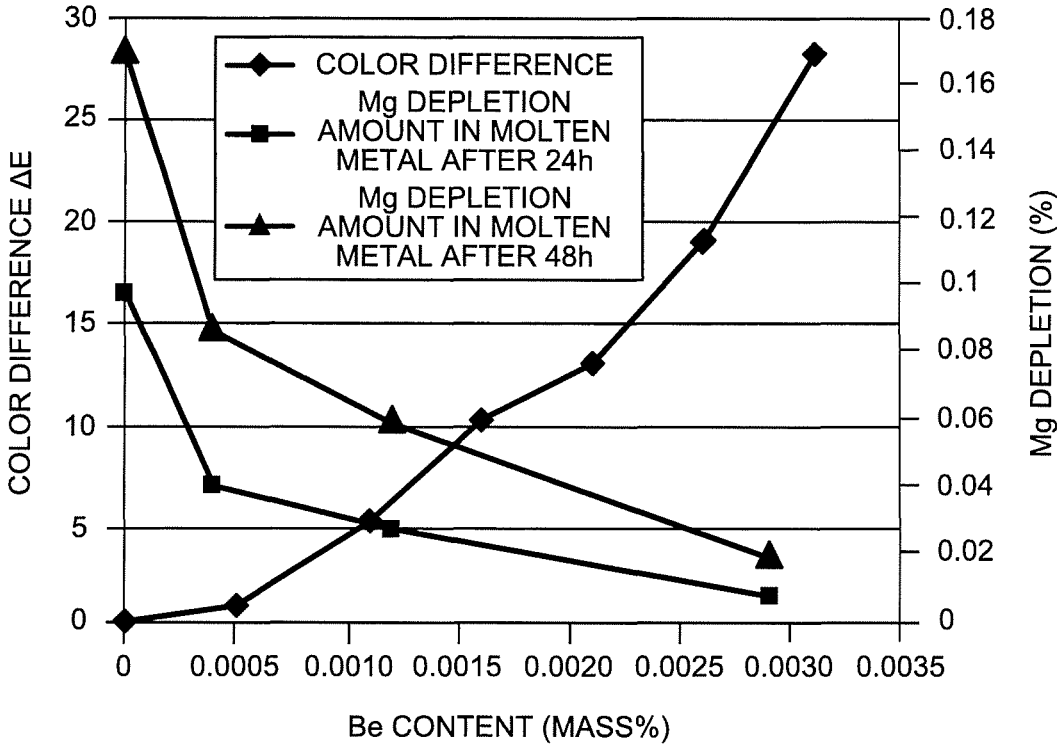
FIG. 1 is a diagram for explaining a relation between a color difference with respect to a Be content in an Al—Si—Mg aluminum alloy for casting and a Mg depletion amount.

An embodiment according to the present invention is described below with reference to the drawings but the present invention is not limited thereto. Constituent elements of the embodiment described below can be combined as appropriate. In some cases, part of the constituent elements may not be used. The constituent elements in the embodiment described below include elements that can be easily conceived of by a person skilled in the art, elements substantially equivalent thereto, and elements within a so-called range of equivalents.

(Alloy Composition)

An Al—Si—Mg aluminum alloy for casting of the present embodiment contains 5 mass % or larger and 10 mass % or smaller of Si, 0.2 mass % or larger and 1.0 mass % or smaller of Mg, 0.03 mass % or larger and 0.5 mass % or smaller of Sb, and 0.0004 mass % or larger and 0.0026 mass % or smaller of Be with the remainder comprising Al and unavoidable impurities.

Si contributes to castability and mechanical properties. The castability improves considerably when the Si content is 5 mass % or larger. The castability is important in making a large cast such as an automobile part. Because the addition of Si makes a Si crystallized matter more likely to coarsen and makes the elongation property more likely to drop, the Si content needs to be kept to 10 mass % or smaller. During aging treatment, Si is precipitated along with Mg as an Mg—Si compound, contributing to improved strength.

Because Mg is precipitated together with Si as the Mg—Si compound in the Al—Si—Mg aluminum alloy for casting of the present embodiment during the aging treatment, Mg provides the effect of improving strength. This effect is significant when the Mg content is 0.2 mass % or larger and even more so when it is 0.3 mass % or larger. Conversely, the Mg content of larger than 1.0 mass % deteriorates the elongation property and promotes oxide production, thereby causing hard spots and other defects. Thus, the Mg content is more preferably 0.3 mass % or larger and 0.5 mass % or smaller, which improves the strength, prevents the deterioration of the elongation property, and inhibits the oxide production.

Sb provides the effects of refining Si in the eutectic structure and improving the elongation property. These effects are significant when the Sb content is 0.03 mass % or larger. When the Sb content is larger than 0.5 mass %, a coarse Mg—Sb compound may be created, which may result in the deterioration of the elongation property.

As described in Prior Art 2, the blackening of the cast surface has been considered unavoidable unless the Al-Si-Mg aluminum alloy contains a large amount of Be. Through extensive research, the inventors of the present invention have discovered that a relation between the Be content in the Al-Si-Mg aluminum alloy and the blackening of the cast surface is not a simple inverse proportional relation. More specifically, they have found that the blackening of the cast surface is unlikely to occur until the Be content in the Al-Si-Mg aluminum alloy reaches a prescribed threshold value; that the blackening occurs easily when the Be content is higher than the prescribed threshold value; and that the blackening is inhibited when the Be content further increases, for example, to 0.05 mass % or larger.

More specifically, Be forms a dense passive oxide film on the molten metal surface of the aluminum alloy and inhibits oxidation of the molten aluminum alloy. Be inhibits Mg depletion in the aluminum alloy. For enhanced effects, the Be content needs to be 0.0004 mass % or larger. However, if the Be content is larger than 0.0026 mass %, the cast surface easily blackens when an ingot is subjected to, after casting, solution treatment, water quenching, and aging treatment, or so-called temper designation T6 heat treatment stipulated in JIS H 0001 (hereinafter referred to as T6 heat treatment). This is presumably because the aluminum oxide layer on the cast surface becomes thick by the T6 heat treatment, which leads to the blackening of the cast surface. In the present embodiment, the Be content of 0.0004 mass % or larger and 0.0026 mass % or smaller inhibits the blackening of the cast surface by the T6 heat treatment.

The Al—Si—Mg aluminum alloy for casting of the present embodiment may also contain an element group selected from titanium (Ti) and/or boron (B) as a refining material of the cast structure, where Ti≤0.15 and B≤0.01% hold.

The Al—Si—Mg aluminum alloy for casting of the present embodiment permits inevitable impurities, but iron (Fe), which gets easily mixed in, is preferably kept to 0.15% or smaller, and other elements of the inevitable impurities are preferably kept to 0.05% or smaller.

The Al—Si—Mg aluminum alloy for casting of the present embodiment permits calcium (Ca), which inevitably gets mixed in. However, if the Ca content is 0.01 mass % or larger, gas absorption becomes intensified and fluidity worsens. Therefore, the Ca content in the Al—Si—Mg aluminum alloy for casting of the present embodiment is preferably 0 mass % or larger and smaller than 0.01 mass %, and more favorably kept to 0 mass % or larger and 0.005 mass % or smaller.

[Manufacturing Method]

The following describes an example of the method for manufacturing a casting material using the Al—Si—Mg aluminum alloy for casting of the present embodiment described above.

(Melting Step)

An aluminum alloy with an alloy composition containing 5 to 10 mass % inclusive of Si, 0.2 mass % or larger and 1.0 mass % or smaller of Mg, 0.03 mass % or larger and 0.5 mass % or smaller of Sb, and 0.0004 mass % or larger and 0.0026 mass % or smaller of Be, and the remainder comprising Al and inevitable impurities is produced by melting with a known method.

The resulting aluminum alloy molten metal undergoes molten metal treatment, such as component adjustment, slag removal, degassing and the like. If Ti and B are contained as refining materials, a rod hardener (refining material) formed with an Al—Ti—B alloy, for example, is added to the aluminum alloy molten metal before casting.

(Casting Step)

The aluminum alloy molten metal obtained in the melting step is poured into a mold to obtain an ingot.

(T6 Heat Treatment)

The ingot obtained in the casting step undergoes the T6 heat treatment to obtain the Al—Si—Mg aluminum alloy casting material of the present embodiment. The T6 heat treatment is heat treatment in which the ingot is subjected to solution treatment, quenching treatment, and aging treatment in sequence.

As conditions of the solution treatment, a solution treatment temperature is held at 500° C. or higher and 550° C. or lower for 2 hours or longer and 12 hours or shorter. As an example of the solution treatment conditions, the solution treatment temperature is held at 535° C. for 4 hours. If the solution treatment temperature is lower than 500° C. or temperature hold time is shorter than 2 hours, the effect of the solution treatment is small. If the solution treatment temperature is higher than 550° C., local melting (burning) may occur. Even if the temperature hold time exceeds 12 hours, no change is seen in amounts of elements of Mg and Si in solid solution, but the costs increase.

The ingot subjected to the solution treatment is water-cooled as the quenching treatment. Water used for the quenching treatment may be warm water.

After the quenching treatment, the ingot forming supersaturated solid solution is subjected to the aging treatment. As conditions for the aging treatment, the aging temperature is held at 120° C. or higher and 180° C. or lower for 2 hours or longer and 12 hours or shorter. As an example of conditions for the aging treatment, the aging temperature is held at 150° C. for 6 hours.

The Al—Si—Mg aluminum alloy for casting and the Al—Si—Mg aluminum alloy casting material of the present embodiment, having undergone the T6 heat treatment, are less blackened after the heat treatment and are excellent in appearance. In the Al—Si—Mg aluminum alloy for casting and the Al—Si—Mg aluminum alloy casting material of the present embodiment, Mg contributes to the mechanical strength as there is little Mg depletion in the molten metal and the temper designation T6 refining stipulated in JIS H 0001 is performed, thereby making the tensile strength 300 MPa or higher and the elongation 10% or greater, for example. The Al—Si—Mg aluminum alloy casting material of the present embodiment, having undergone the T6 heat treatment, is manufactured as an automobile part, for example.

Examples

The following describes examples of the present invention. In Example 1, Example 2 and Comparative Example 1, an aluminum alloy having elements of an alloy composition of Table 1 and the remainder of Al was melted to manufacture a molten metal for evaluation. The temperature of each manufactured molten metal for evaluation was held at 850° C., and the Mg content was measured after 24 hours and 48 hours. Each measured Mg content was subtracted from the Mg content immediately after the melting to calculate the Mg depletion amounts in the molten metal after 24 hours (h) and 48 hours (h), and the results are listed in Table 1.

TABLE 1

| | Alloy composition (mass %) | | | | Mg depletion in molten metal (mass %) | |
|---|---|---|---|---|---|---|
| | Si | Mg | Sb | Be | After 24 h | After 48 h |
| Example 1 | 5.3 | 0.40 | 0.10 | 0.0004 | 0.04 | 0.09 |
| Example 2 | 5.5 | 0.39 | 0.10 | 0.0012 | 0.03 | 0.06 |
| Comparative Example 1 | 5.5 | 0.40 | 0.10 | <0.0001 | 0.10 | 0.17 |

It was confirmed that the Mg depletion amount in the molten metal was obviously smaller in Example 1 and Example 2 than that in Comparative Example 1 with a Be content smaller than 0.0001 mass %. Therefore, in Example 1 and Example 2, Mg added for strength improvement becomes less oxidized and depleted in the molten metal than Mg in Comparative Example 1, thereby lowering the possibility of promoting oxide production and gas absorption. As a result, in Example 1 and Example 2, the molten state is less affected than that in Comparative Example 1 and a casting material with improved strength can be stably manufactured.

In Comparative Example 2, Examples 3 to 7 and Comparative Example 3, casting materials were manufactured with the manufacturing method described above so as to make aluminum alloys having the elements of the alloy composition of Table 2 and the remainder of Al. Each casting material was cast into a boat shape using gravity die casting in the same die. Each casting material underwent the T6 heat treatment after water-cooling to sequentially perform the solution treatment, in which the casting material was held at a holding temperature of 535° C. for 4 hours, the quenching treatment, and the aging treatment, in which the casting material was held at a holding temperature of 150° C. for 6 hours.

Subsequently, a color-difference meter (CR-400 manufactured by Konica Minolta Japan, Inc.) was used to obtain a body color of the surface of each casting material on the basis of JIS Z 8722. A color difference ΔE was calculated for the resulting body colors using the body color of the second comparative example with Be of smaller than 0.0001 mass % as a standard on the basis of JIS Z 8730.

TABLE 2

| | Alloy composition (mass %) | | | | Color difference |
|---|---|---|---|---|---|
| | Si | Mg | Sb | Be | ΔE |
| Comparative Example 2 | 5.5 | 0.41 | 0.09 | <0.0001 | 0 |
| Example 3 | 5.5 | 0.41 | 0.09 | 0.0005 | 0.8 |
| Example 4 | 5.5 | 0.41 | 0.09 | 0.0011 | 5.0 |
| Example 5 | 5.5 | 0.41 | 0.09 | 0.0016 | 10.0 |
| Example 6 | 5.5 | 0.41 | 0.09 | 0.0021 | 12.8 |
| Example 7 | 5.5 | 0.41 | 0.10 | 0.0026 | 18.9 |
| Comparative Example 3 | 5.5 | 0.41 | 0.09 | 0.0031 | 28.1 |

Figure 2:
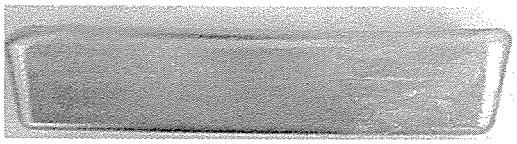
FIG. 2 is a diagram illustrating examples of appearances of side surfaces of casts after heat treatment.
Figure 2:
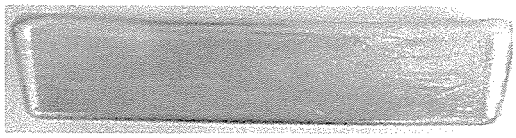
Figure 2:
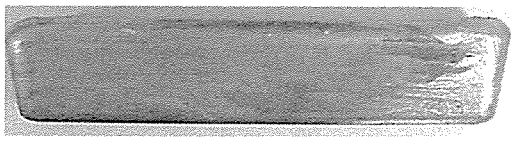

The resulting color differences ΔE for Examples 3 to 7 and Comparative Example 3 compared to Comparative Example 2 are listed in Table 2. FIG. 1 is a diagram for explaining a relation between a color difference with respect to a Be content in the Al—Si—Mg aluminum alloy for casting and a Mg depletion amount. FIG. 2 is a diagram illustrating examples of appearances of the side surfaces of casts after the heat treatment.

As can be understood from FIG. 1, the Al—Si—Mg aluminum alloy for casting and the Al—Si—Mg aluminum alloy casting material have a Be content of 0.004 mass % or larger and 0.026 mass % or smaller, thereby inhibiting the blackening of the cast surface that has been refined with the temper designation T6 specified in JIS H 0001, while inhibiting the depletion amount of Mg in the molten metal.

As illustrated in FIG. 2, Comparative Example 2 and Example 6 are visually recognized as silver and the third comparative example is visually recognized as black. The third comparative example has a Be content larger than 0.0026 mass % and it is understood from FIG. 2 that the surface is blackened. As illustrated in FIG. 2, the larger the color difference ΔE from the color of Comparative Example 2 is, the more significant the blackening becomes. As can be understood from FIG. 2 and Table 2, if the color difference ΔE from the color of the second comparative example is 19 or larger, the blackness of the cast surface can be easily visually recognized.

Various useful examples of the present embodiment have been illustrated and described above. The present embodiment is not limited to Examples described above or modifications thereof, and it goes without saying that various changes can be made in the embodiment without departing from the gist of the present embodiment or the attached claims.

The invention claimed is:

1. A method for manufacturing an Al-Si-Mg aluminum alloy casting material, the method comprising:

performing heat treatment to sequentially perform:

solution treatment on an Al-Si-Mg aluminum alloy casting material containing:

5 mass % or larger and 10 mass % or smaller of Si, 0.2 mass % or larger and 1.0 mass % or smaller of Mg, 0.03 mass % or larger and 0.5 mass % or smaller of Sb, 0 mass % or larger and smaller than 0.01 mass % of Ca, 0.0004 mass % or larger and 0.0026 mass % or smaller of Be, and a remainder Al and unavoidable impurities;

quenching treatment; and aging treatment.

2. The method for manufacturing an Al-Si-Mg aluminum alloy casting material according to claim 1, wherein in the solution treatment, a temperature is held at 500° C. or higher and 550° C. or lower for 2 hours or longer and 12 hours or shorter, and in the aging treatment, a temperature is held at 120° C. or higher and 180° C. or lower for 2 hours or longer and 12 hours or shorter.

3. The method for manufacturing an Al-Si-Mg aluminum alloy casting material according to claim 1, wherein a content of Ca in the Al-Si-Mg aluminum alloy casting material is 0 mass % or larger and smaller than 0.005 mass %.

* * * * *